US009433066B2

(12) United States Patent
Burkhart

(10) Patent No.: US 9,433,066 B2
(45) Date of Patent: Aug. 30, 2016

(54) MUSIC SYNCHRONIZED LIGHT MODULATOR

(71) Applicant: Scott Burkhart, Livermore, CA (US)

(72) Inventor: Scott Burkhart, Livermore, CA (US)

( * ) Notice: Subject to any disclaimer, the term of this patent is extended or adjusted under 35 U.S.C. 154(b) by 177 days.

(21) Appl. No.: 14/092,895

(22) Filed: Nov. 27, 2013

(65) Prior Publication Data

US 2014/0152181 A1 Jun. 5, 2014

Related U.S. Application Data

(60) Provisional application No. 61/732,224, filed on Nov. 30, 2012.

(51) Int. Cl.
*H05B 37/02* (2006.01)
*H05B 33/08* (2006.01)

(52) U.S. Cl.
CPC ..... *H05B 37/029* (2013.01); *H05B 33/0857* (2013.01); *H05B 33/0863* (2013.01)

(58) Field of Classification Search
CPC ..... H05B 37/029; H05B 33/0857; H05B 33/0818; H05B 33/0833; H05B 33/0839; H05B 33/0845; H05B 33/0863
See application file for complete search history.

(56) References Cited

U.S. PATENT DOCUMENTS 7,233,115 B2 * 6/2007 Lys ..... F21S 48/325 315/224
8,692,471 B2 * 4/2014 Seo ..... H05B 33/0818 315/186
8,907,884 B2 * 12/2014 Thompson ..... G09G 3/342 345/102
2005/0217457 A1 10/2005 Yamamoto et al.
2006/0049959 A1 * 3/2006 Sanchez ..... H05B 33/0818 340/855.3
2008/0122762 A1 5/2008 Haung et al.
2009/0189539 A1 * 7/2009 Deng ..... H05B 33/0812 315/294
2009/0302776 A1 * 12/2009 Szczeszynski ..... H05B 33/0815 315/246
2011/0101880 A1 5/2011 Ribarich
2011/0260631 A1 10/2011 Park et al.
2012/0025722 A1 2/2012 Mokry et al.
2012/0280628 A1 11/2012 Jin

FOREIGN PATENT DOCUMENTS

DE 10013207 A1 9/2001
GB 2466940 A 7/2010

OTHER PUBLICATIONS

International Search Report dated Feb. 25, 2014 for PCT application No. PCT/US2013/072433.

* cited by examiner

*Primary Examiner* — Jung Kim
(74) *Attorney, Agent, or Firm* — Mintz Levin Cohn Ferris Glovsky and Popeo, P.C.

(57) ABSTRACT

The subject matter disclosed herein relates to a system for controlling strings of lights. This system can include a host controller, one or more strings of lights, and an effects modulator. Each string of light can include at least one LED light. The effects modulator can be operatively connected to the host controller and to the strings of light. The effects modulator can include a microcontroller and an inverter. The inverter can include a high side driver circuit and one or more low side driver circuits operatively connected to the high side driver circuit. Each low side driver circuit can be operatively connected to one of the strings of light. The microcontroller can be configured to receive one or more control signals from the host controller and control the strings of light via the inverter in accordance with the control signals. Related apparatus, methods, and techniques are also described.

22 Claims, 14 Drawing Sheets

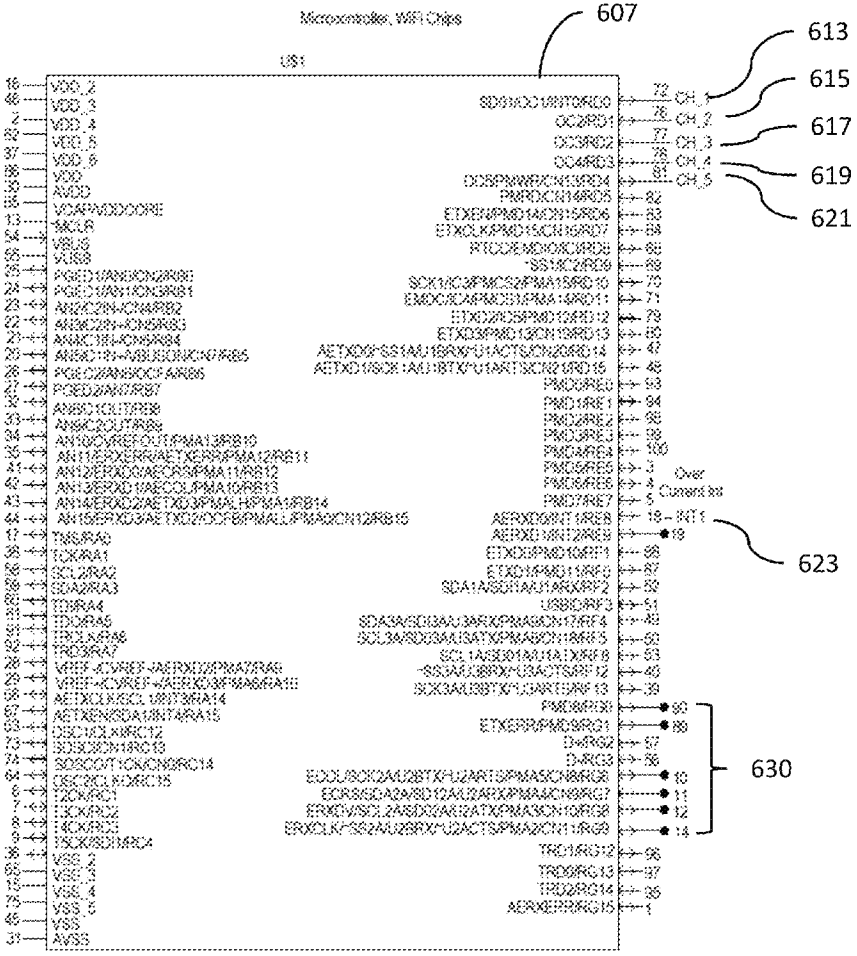
FIG. 6A1

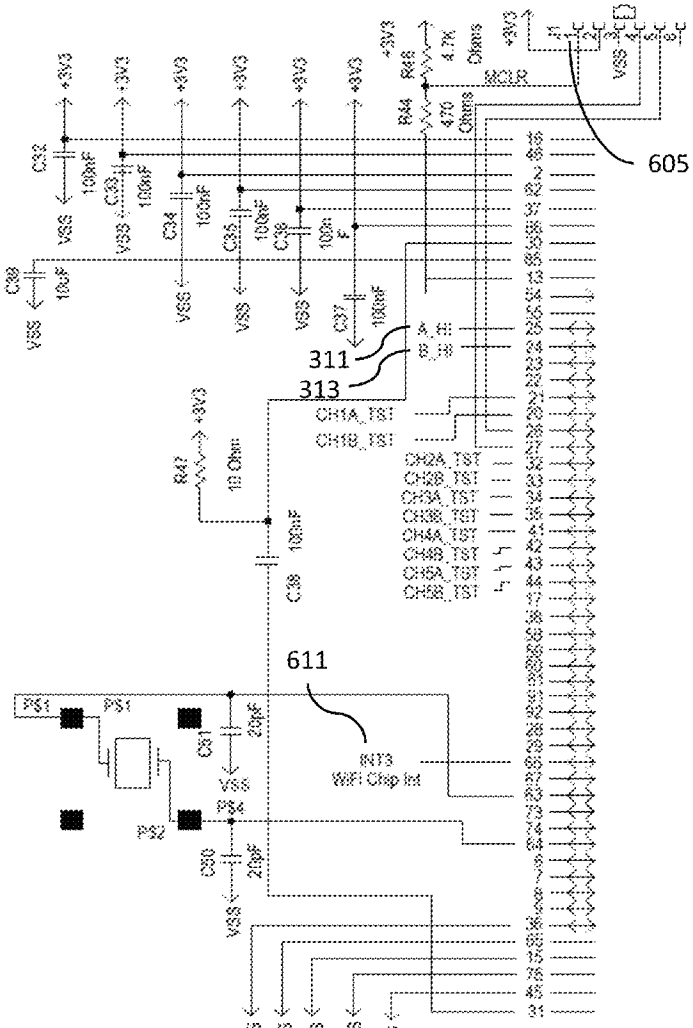
FIG. 6A2

MUSIC SYNCHRONIZED LIGHT MODULATOR

CROSS REFERENCE TO RELATED APPLICATIONS

This application claims the benefit of priority under 35 U.S.C. §119(e) of U.S. Patent Application Ser. No. 61/732,224, filed Nov. 30, 2012, entitled "Music Synchronized Light Modulator", the contents of which are incorporated herein by reference in their entirety for all purposes.

TECHNICAL FIELD

This disclosure relates generally to the control of light emitting diodes (LEDs) and, in particular, to the synchronization of LEDs to music.

BACKGROUND

Lighting technology has been subject to considerable development and variation. Holiday lighting, for example, utilizes large electric light arrays to decorate trees, buildings, and other structures. In the performance arts, for example, strings of lights are set to music to create interactive shows. In many of these applications, incandescent lights bulbs are used to create light effects. While incandescent light bulbs are relatively inexpensive, the cost associated with operating these types of lights can be expensive. In addition, because incandescent light bulbs cannot turn on and off instantaneously, lights effects created by these lights may experience delay or latency issues.

SUMMARY

In some implementations, methods and apparatus, including computer program products, are provided for controlling one or more strings of lights.

In some implementations, there is provided a system that includes a host controller, one or more strings of lights, and an effects modulator. Each of the one or more strings of light includes at least one LED light. The effects modulator is operatively connected to the host controller and to the one or more strings of light. The effects modulator includes a microcontroller an inverter. The inverter includes a high side driver circuit and one or more low side driver circuits operatively connected to the high side driver circuit. Each of the one or more low side driver circuits is operatively connected to one of the strings of light. The microcontroller is configured to receive one or more control signals from the host controller and control the one or more strings of light via the inverter in accordance with the one or more control signals.

The above system can, in some implementations, further include one or more of the following features.

The high side driver circuit can further include a first side having a first switch and a second side having a second switch. The microcontroller can be configured to connect the first switch and the second switch to a DC voltage source in accordance with a predetermined pattern. The predetermined pattern can connect the first switch to the DC voltage source during a first half of a drive frequency and connect the second switch to the DC voltage source during a second half of the drive frequency. The first switch and the second switch can be configured to provide high side drive waveforms to the one or more low side driver circuits.

The one or more low side drivers circuits can be configured to receive the high side drive waveforms from the first switch and the second switch and turn on the one or more strings of light by staggering a turn on time for the one or more strings of light using the high side drive waveforms. The turn on time for the one or more strings of light can be staggered by 25 nanoseconds to 694 microseconds.

The first switch and the second switch can be MOSFETs.

One or more diodes can be disposed between the high side driver circuit and the one or more low side driver circuits. The one or more diodes can electrically isolate the one or more low side driver circuits from each other.

The system can further include a power supply. The inverter can be configured to operate at a drive frequency that is greater than a frequency of a line voltage connected to the power supply. The power supply can be configured to maintain a fixed potential relative to the effects modulator while a potential relative to earth ground floats.

The effects modulator can be operatively connected to the host controller by a hardwired link or a wireless communication link. The hardwired link can be an opto-isolator link or a fiber optic link.

The system can further include a zero crossing interrupt operatively connected to the microcontroller. The zero crossing interrupt can be configured to resynchronize the microcontroller to operate at a predetermined frequency.

The system can further include an over current interrupt circuit operatively connected to the microcontroller. The over current interrupt circuit can be configured to interrupt the microcontroller and disable at least one of the high side driver circuit or the one or more low side driver circuits when a fault condition is detected.

The system can further include an effects editor configured to create one or more light effects waveforms for the one or more strings of light and to transmit the one or more light effects waveforms to the microcontroller. The effects editor can be further configured to intercept one or more MIDI signals representative of a MIDI event by an input device operatively connected to the effects editor and to transmit the one or more MIDI signals to the effects modulator. The MIDI event can be a NOTE-ON event, and the one or more MIDI signals can include information representative of the NOTE-ON event, a channel associated with the NOTE-ON event, a pitch associated with the NOTE-ON event, and a velocity associated with the NOTE-ON event.

The effects modulator can be configured to receive the one or more MIDI signals from the effects editor, copy a light effect waveform corresponding to the received one or more MIDI signals into one or more play buffers in the microcontroller, and modulate the one or more strings of light in accordance with the copied light effect waveform.

The host controller can be configured to transmit one or more timing signals to the effects modulator at predetermined intervals to synchronize the effects modulator with the host controller.

A pulse width of the one or more low side driver circuits can be adjusted to reduce flicker.

In some implementations there is provided an apparatus that includes a microcontroller and an inverter. The inverter includes a high side driver circuit and one or more low side driver circuits operatively connected to the high side driver circuit. Each of the one or more low side driver circuits is operatively connected to one of a plurality of strings of light. The microcontroller is configured to receive one or more control signals from a host controller and control the plurality of strings of light in accordance with the one or more control signals.

The above apparatus can, in some implementations, further include one or more of the following features.

The high side driver circuit can further include a first side having a first switch and a second side having a second switch. The microcontroller can be configured to connect the first switch and the second switch to a DC voltage source in accordance with a predetermined pattern. The first switch and the second switch can be configured to provide high side drive waveforms to the one or more low side driver circuits.

The one or more low side drivers circuits can be configured to receive the high side drive waveforms from the first switch and the second switch and turn on the one or more strings of light by staggering a turn on time for the one or more strings of light using the high side drive waveforms.

In some implementations there is provided a method for controlling one or more strings of lights. This method receives, by an effects modulator, one or more control signals from a host controller. This method also controls, by the effects modulator, one or more strings of light connected to the effects modulator in accordance with the one or more control signals.

It is to be understood that both the foregoing general description and the following detailed description are exemplary and explanatory only and are not restrictive. Further features and/or variations may be provided in addition to those set forth herein. For example, the implementations described herein may be directed to various combinations and subcombinations of the disclosed features and/or combinations and subcombinations of several further features disclosed below in the detailed description.

DESCRIPTION OF DRAWINGS

The accompanying drawings show certain aspects of the subject matter disclosed herein and, together with the description, help explain some of the principles associated with the disclosed implementations.

FIGS. 6A1, 6A2, and 6B are a circuit diagram of the microcontroller and integrated WiFi component consistent with an implementation of the current subject matter.

When practical, similar reference numbers denote similar structures, features, or elements.

DETAILED DESCRIPTION

This document discloses techniques for synchronizing LED string lights to music. Some implementations of the current subject matter use an effects modulator that can be plugged directly into a wall mounted outlet to control LED string lights and create dazzling light effects.

Figure 1:
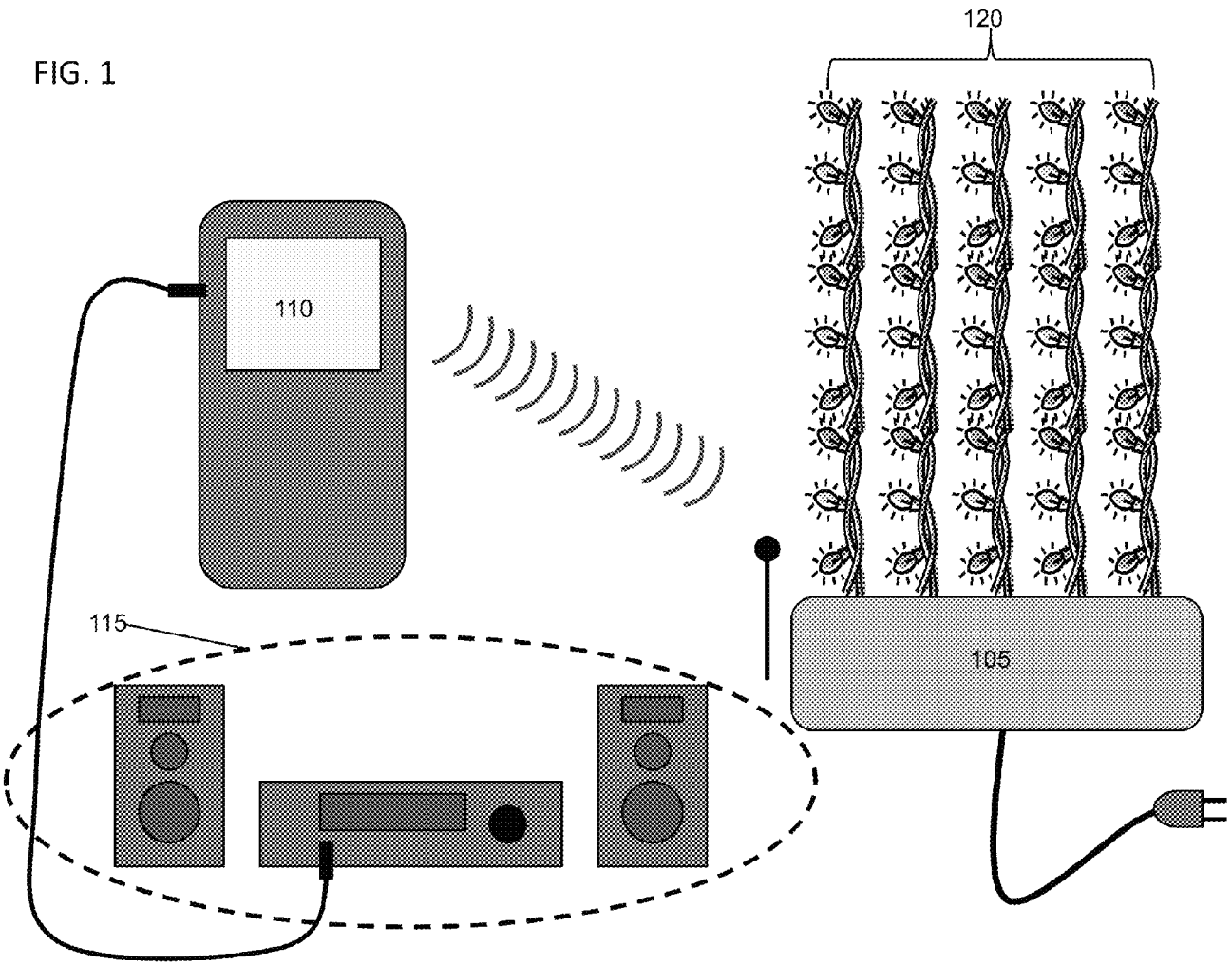
FIG. 1 is a system level diagram consistent with an implementation of the current subject matter.

FIG. 1 illustrates a system for turning a set of LED string lights on and off in accordance with music while adjusting light brightness at a rate of 210 adjustments per second. This system can include an effects modulator 105, a host controller 110, a music system 115, and a set of LED string lights 120. LED string lights 120 can operate at 110 V or lower voltages (e.g., a low voltage LED) and can be electrically connected to effects modulator 105 which, in turn, can be plugged directly into a wall mounted outlet. Although five sets of LED string lights 120 are illustrated in FIG. 1, any number of sets can be used. Effects modulator 105 can have a wireless communication link with host controller 110. In some implementations the link between effects modulator 105 and host controller 110 can be a hardwired link such as a universal serial bus (USB) connection or other opto-isolator link or fiber optic link. When a user selects a piece of music to play using host controller 110, the host controller can transmit control signals to effects modulator 105 to modulate the LED string lights 120 to varying levels of brightness using pulse width modulation techniques. These brightness levels can include a minimum intensity (e.g., off condition) a maximum intensity, and 256 intervening intensity levels. Host controller 110 can be a media player including, for example, a computer, an iPod, or an iPad. The terms host controller and media player are used interchangeably throughout this document. Music system 115 has sound generators that can output the music as LED string lights 120 are modulated.

Figure 2:
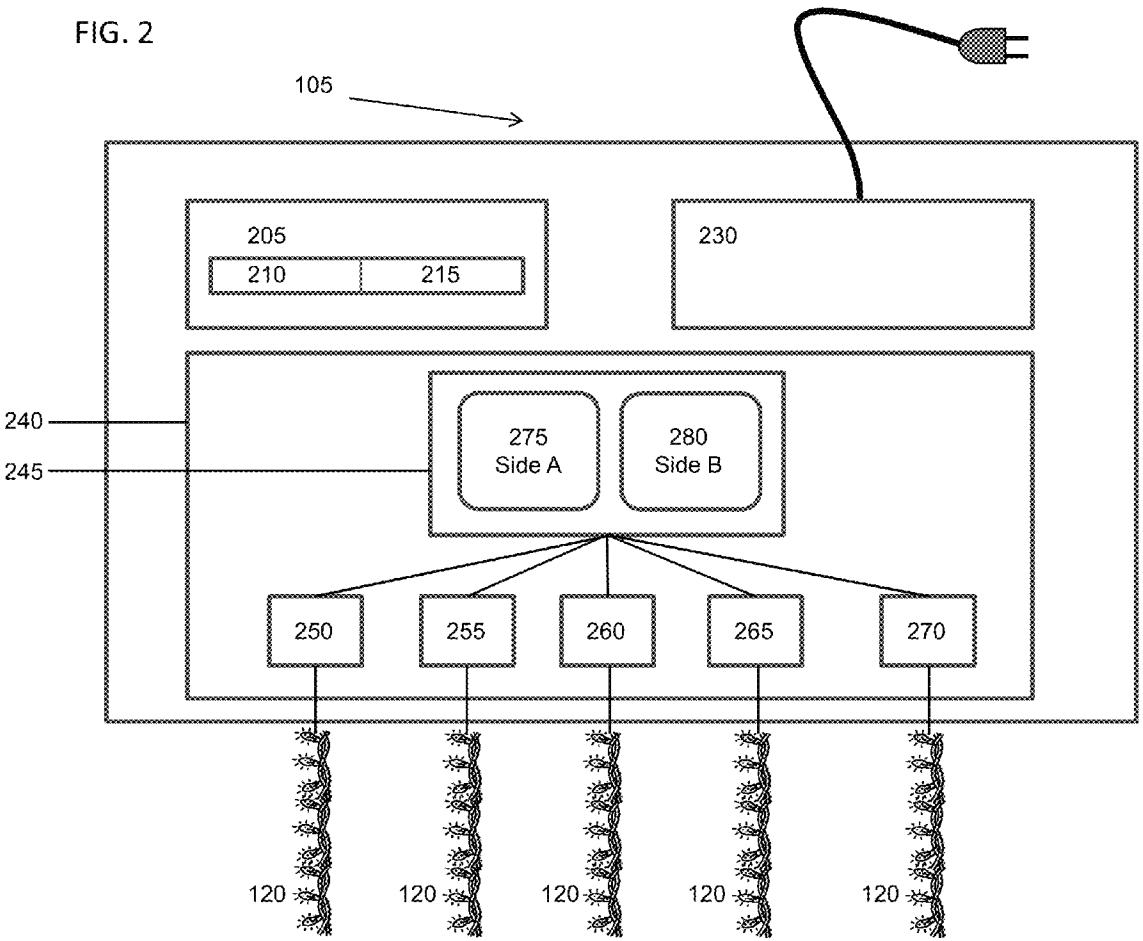
FIG. 2 is a block diagram of the effects modulator consistent with an implementation of the current subject matter.

FIG. 2 illustrates a block diagram of effects modulator 105. Effects modulator 105 has a high voltage inverter 240, a microcontroller 205, and a power supply 230. Each of these components is described below.

High Voltage Inverter

High voltage inverter 240 can turn LED string lights 120 on and off in accordance with light effects data received from microcontroller 205. High voltage inverter 240 can operate at 360 Hz instead of the 60 Hz received from the line voltage. Increasing the frequency to 360 Hz increases the rate at which the LED string lights turn on and off and, consequently, reduces flicker and other visually distracting effects. This is possible because the modulation speed is beyond human detection and perceived as a continuous range of brightness from zero to maximum brightness.

Each LED string light 120 has a positive and a negative side that can be connected to either end of high voltage inverter 240. High voltage inverter 240 can connect the positive and negative sides of LED string light 120 to +150 VDC in an alternating manner at a rate of 360 times per second. When one side is at +150 VDC, the other side can be connected to ground for a time period specified by pre-programmed lights effects data. This time period can extend from 0 seconds to (1/720) second. As described below, a user can create light effects data to control the light intensity of the LED string lights.

High voltage inverter 240 has a high-side driver circuit 245. High-side driver circuit 245 can have a pair of switches or MOSFETs, and each MOSFET can correspond to a different side of the high-side driver. In the implementation of FIG. 2, high side driver circuit 245 can have two sides—side A (275) and side B (280). The output of high-side driver circuit 245 can connect to the input of low-side drivers 250, 255, 260, 265, and 270.

In a standard inverter circuit, there is a one-to-one relationship between high-side drivers and low-side drivers. In these standard inverter circuits, each high-side driver is connected to its own individual low-side driver which, in turn, is connected to one side of a string light. As such, two high-side drivers and two low-side drivers are required for each string light in standard inverter circuits. With regard to inverter 240, however, a single pair of high-side drivers 245 can be shared by all of low-side drivers 250, 255, 260, 265, 270, and their corresponding LED string lights 120. When side A (275) of high-side driver 245 is connected by its MOSFET to the +150V, then the five low-side drivers 250, 255, 260, 265, and 270 can connect the low B side to ground. During the other half cycle of the 360 Hz driver frequency, side B (280) of high-side driver 245 can connect to the +150V by its MOSFET, and the five low-side drivers 250, 255, 260, 265 and 270 can connect the low A side to ground.

Because LED string lights 120 operate on either A or B sides at the same time, only one high-side pair of MOSFETS is needed. In the implementation of FIG. 2, high-side driver 245 can be a circuit that runs off a nominal 12 VDC. Because MOSFETS 275 (side A) and 280 (side B) can have a characteristic high input capacitance, they can be driven by exemplary MOSFET drivers U1 and U3 shown in FIG. 3.

Figure 3:
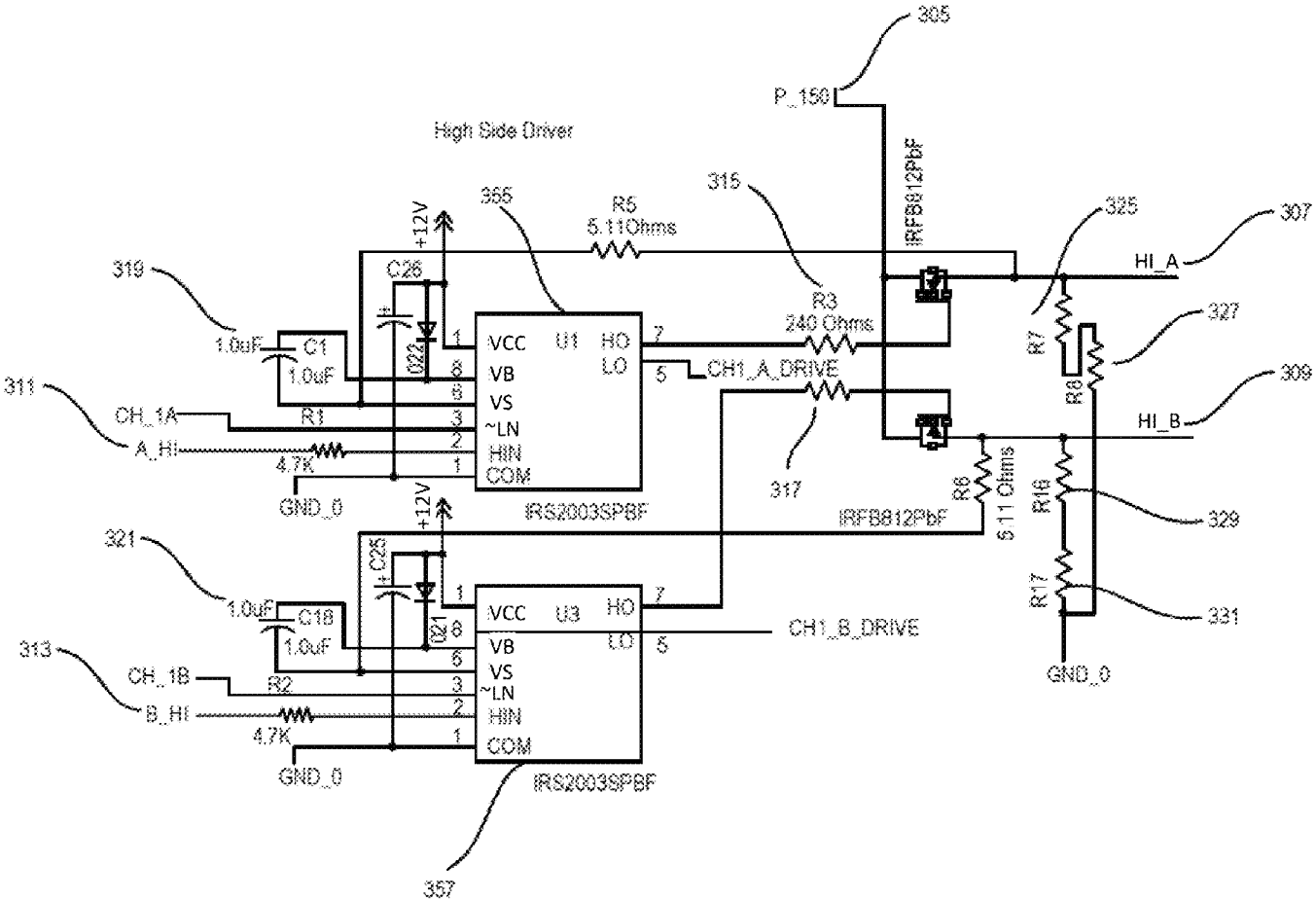
FIG. 3 is a circuit diagram of a high-side driver consistent with an implementation of the current subject matter.

FIG. 3 is a circuit diagram of high-side driver circuit 245. This circuit can provide high-side drive waveforms through outputs HI_A and HI_B. These outputs can be driven in an alternating manner to a voltage having a value designated by P_150. In the implementation of FIG. 3, the P_150 voltage (305) is the nominal 110 Volts AC line voltage from the wall plug, rectified to approximately 150 VDC. Outputs HI_A (307) and HI_B (309) can be connected to the P_150 line voltage (305) via MOSFET transistors at 360 Hz and driven by high voltage half bridge drivers U1 and U3, respectively. Drivers U1 and U3 can be configured to translate logic inputs A_HI (311) and B_HI (313) to the high drive current and high voltage (e.g., 12 V higher than the nominal P_150 line voltage) required to adequately turn-on high side MOSFETs 275 and 280.

Resistors R3 (315) and R4 (317) can be used to slow the drive transition turn-on time to minimize radiated EM. This is not an electronic efficiency or MOSFET heating issue at the slow (360 Hz) switching speeds described above. In the implementation of FIG. 3, resistors R3 (315) and R4 (317) can have a value of 240 Ohms which may be larger than normally recommended for these MOSFETS. Drivers U1 (355) and U3 (357) can have charge pump circuitry that can charge capacitors C1 (319) and C18 (321) to approximately 12V above the P_150 voltage (305). Charging capacitors C1 (319) and C18 (321) to this value may be required for MOSFET bias. For this to work properly, a suitable path to ground can be provided at the MOSFET sources which can be tied to outputs HI_A (307) and HI_B (309) for the two MOSFETs. Because low-side drivers 250, 255, 260, 265, and 270 may not provide a consistent path to ground, particularly during quiescent periods when the LED string lights are turned off, resistors R7 (325), R8 (327), R16 (329), and R17 (331) can be used to provide an adequately low impedance path to ground to maintain the proper bias on capacitors C1 (319) and C18 (321). Including gate resistors R3 (315) and R4 (317) and grounding resistors R7 (325), R8 (327), R16 (329), and R17 (331) can prevent the circuit of FIG. 3 from failing and prevent possible damage to the MOSFETs.

Figure 4:
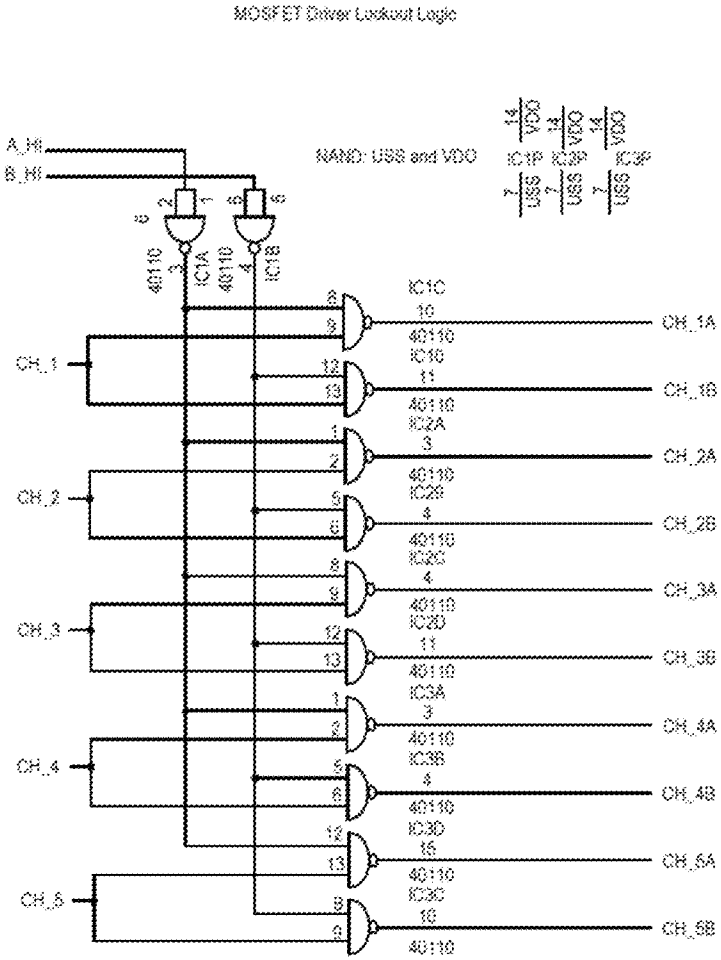
FIG. 4 is a circuit diagram of the MOSFET driver lockout logic consistent with an implementation of the current subject matter.

FIG. 4 is a circuit diagram of the MOSFET driver lockout logic. This logic can be implemented using CMOS gates to ensure that the low-side drive is not enabled when the corresponding high-side drive is enabled on the same side of the full-bridge circuit. Although the implementation of FIG. 4 uses CMOS gates, other implementations using, for example, a microcontroller, field programmable gate array logic, or the equivalent, are also envisioned.

Figure 5:
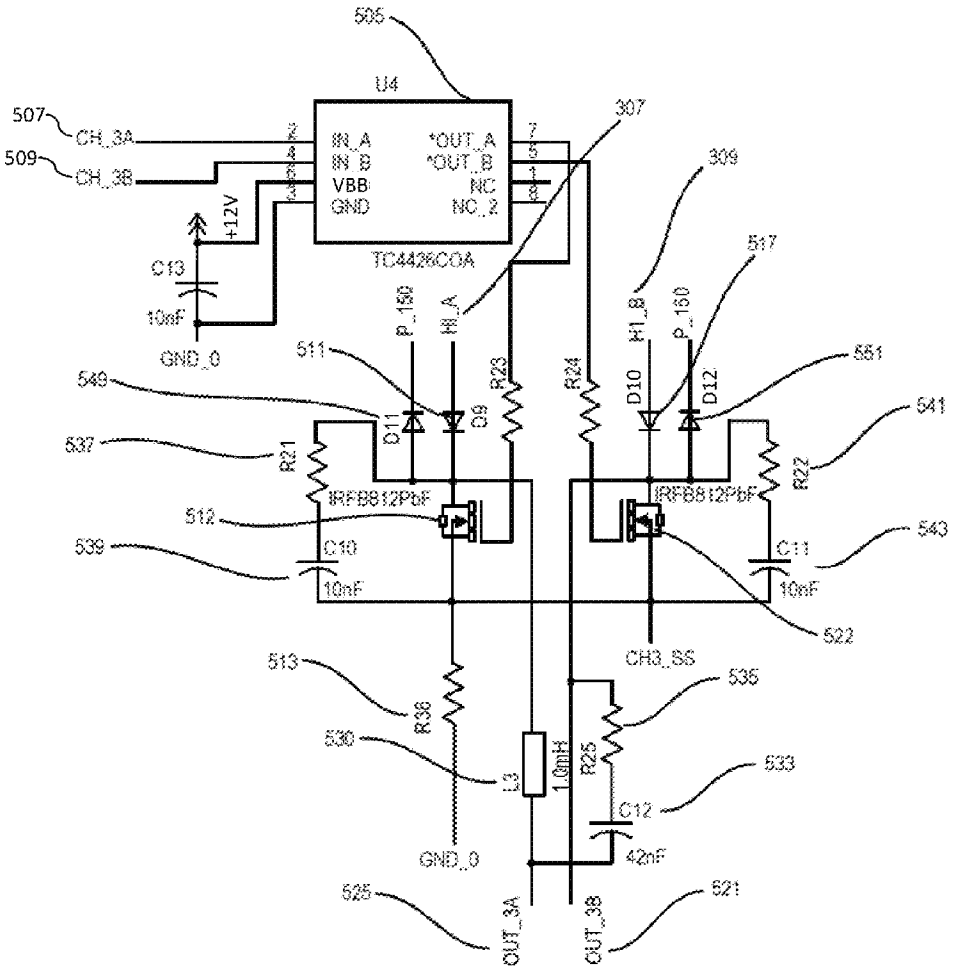
FIG. 5 is a circuit diagram of the low-side driver and an output connection between the low-side driver and the LED string light consistent with an implementation of the current subject matter.

FIG. 5 is a circuit diagram of a low-side driver circuit. This low-side driver circuit can correspond to any of low-side drivers 250, 255, 260, 265, and 270. Low-side driver U4 (505) can be used to translate the low-voltage logic signal input to the high transient-current (nominal) 12V gate drive required by the MOSFETs. In the implementation of FIG. 5, low-side driver U4 (505) can be implemented using an International Rectifier Inc. IRS4428 or equivalent driver from other manufacturers.

To electrically isolate the low-side drivers from each other, each low-side driver can be fed to the high side A MOSFET (275) or high side B MOSFET (280) by diodes or any equivalent device that conducts current in only one direction. Using this technique, only one pair of high-side MOSFETs are required for the five inverter circuits as explained above. Without the diode, each of the low-side drivers would drive all five circuits, and the circuits would not act independently. The A and B sides can be alternately turned on and connected to +150V at an alternating frequency of 360 Hz. Each side can be on for 1.39 ms or ($1/720$) of a second in an alternating fashion. To control damaging or destructive MOSFET behavior, microcontroller 205 can conduct a carefully programmed commutation between the phases of the A and B sides to shut down the low side drivers and invoke appropriate dead-times to permit orderly MOSFET turn-off and turn-on. In order to minimize radiated EM or other deleterious effects from simultaneously turning on or off all channels, LED brightness can be varied by centering or displacing the modulated pulses in the time window to decorrelate the on/off times between channels. This process can stagger the turn-on times for the LED string lights by 25 nanoseconds to 694 microseconds.

Low-side driver U4 (505) can translate the logic drive from output lines CH_3A (507) and CH_3B (509) of FIG. 4 to 12V drive through pins 5 and 7. When CH_3A (507) is enabled, the left side MOSFET (512) between diode D9 (511) and resistor R38 (513) can be turned on. When the left side MOSFET (512) is turned on, microcontroller 205 can turn on the HI_B voltage (309) as described above with respect to FIG. 3. When the HI_B voltage (309) is turned on, current can flow through diode D10 (517) to output OUT_3B (521), through the connected LED string lights (not shown), and through output OUT_3A (525) and to ground through the left-side MOSFET and resistor R38 (513).

Likewise, during the other half of the 360 Hz cycle, when the HI_A input (307) is at 150V, current can flow out through diode D9 (511) and inductor L3 (530), through output OUT_3A (525) to the LED string lights (not shown), back into output OUT_3B, and through the right-side MOSFET (522) (below diode D10) to ground through resistor R38.

The low pass filter formed by inductor L3 (530), capacitor C12 (533), and resistor R25 (535) can suppress high frequency transients which, in turn, can reduce radiated electromagnetic interference. Snubber resistor-capacitor pairs R21 (537)-C10 (539) and R22 (541)-C11 (543) can help protect the MOSFETs from rapid turn on and suppress damaging electrical transients. Reverse-biased diodes D11 (549) and D12 (551) can prevent large transient voltages from overstressing the MOSFETs. Resistor R38 (513) can be used as a current sensing resistor that detects unwanted overcurrent conditions, such as a short circuit or failed component. When these unwanted conditions occur, the circuitry can be shut down.

The circuitry described above with respect to low-side driver U4 (505) can be replicated for any of low-side drivers 250, 255, 260, 265, and 270. A person of ordinary skill in the art would recognize that the light string connected to low side driver 250 in FIG. 2. may not need its own low-side driver chip because it can use the available low-side drive from the half-bridge drivers illustrated on FIG. 3.

FIG. 5 output connections "OUT_3A" (525) and "OUT_3B" (521) can be routed back to microcontroller 205. Resistor pairs can provide attenuated samples of the output voltages back to microcontroller 205. These samples can be attenuated by a ratio of 100:1. As such, a 150V signal can appear as 1.5V at microcontroller 205 which can sample the signal as part of a self-diagnostic sequence.

Microcontroller

Microcontroller 205 can turn LED string lights 120 on and off in accordance with control signals received from media player 110. Commercially available chips including, for example, Microchip's line of microcontrollers can be used. In one implementation, microcontroller 205 can be a 795 processor that is programmed in C. Because modulator 105 can be plugged directly into a wall outlet, power received through this connection has a frequency of 60 Hz. Microcontroller 205 can be interrupt-driven to invert the rectified line voltage to 360 Hz synchronous with the 60 Hz line voltage to eliminate flicker aliasing which can become noticeable at 60 Hz or less. In some implementations, FIG. 2 can include voltage monitoring circuitry operatively connected to microcontroller 205. This voltage monitoring circuitry can modify the pulse width modulation to minimize or eliminate 60 Hz flickering due to the normal 120 Hz ripple from the standard full-bridge rectifier and capacitor circuitry.

Microcontroller 205 can communicate with media player 110 using a wired or wireless connection including, for example, WiFi, Bluetooth, USB, an optical connection, and the like. When a user selects a song to play using media player 110, microcontroller 205 can download light effects data from the music file of the selected song. This download process can occur in multiple parts to permit prompt commencement of the music and light effects.

In an exemplary implementation, microcontroller 205 can download the first fifty seconds of light effects data to buffer 210 while the selected music file starts playing. When half of the lights effects data in buffer 210 has been consumed (i.e., used to control the LED string lights), microcontroller 205 can download the next fifty seconds of light effects data to the remaining half of buffer 210. When the first half of buffer 210 is consumed (played), the microcontroller can switch over and begin playing the light effects from the second half of the buffer 210. Once the second half begins playing, the microcontroller can request and receive the next fifty seconds of light effects data to re-fill the first half of buffer 210. Additional blocks of light effects data can be downloaded to buffers 210 and 215 in an alternating fashion. Thus while one buffer is being played, the other buffer can be refilled with light effect data back-and-forth until all the light effect data is played. Other buffering methods can also be implemented, such as a 3-buffer method for music playback, a ring buffer, and the like.

Microcontroller 205 can also control the high-side MOSFETs in 275 and 280 in high voltage inverter 240. The MOSFET control circuits in 275 and 280 control the A and B sides respectively. Microcontroller 205 can alternate between turning on high-side MOSFET 275 (side A) or high-side MOSFET 280 (side B) at 360 Hz. However, for the MOSFETs in low-side drivers 250, 255, 260, 265 or 270, the pulse width can be varied between 0 and (1/720) second with 256 levels as programmed in the light effects file as explained above with respect to FIG. 5. To ensure that the high-side MOSFET 275 or 280 and the respective low-side drivers in FIG. 5 are not simultaneously activated, the MOSFET driver lockout logic described above with respect to FIG. 4 or other logic can be used to prevent a dead-short of the 150 VDC on either the A or B side through the low-side MOSFETs.

FIGS. 6A1, 6A2, and 6B illustrate a circuit diagram for microcontroller 205 and its integrated WiFi component. In the implementation of FIGS. 6A1, 6A2, and 6B, commercially available microcontrollers including, for example, Microchip's PIC32MX795F512 microcontroller, can be used. This microcontroller can contain the programming, timers, and communication interfaces needed to drive the LED string lights in accordance with a timed schedule while communicating with a media player to download LED string light modulation sequences (i.e., light effects data).

Connector J1 (605) at the top of FIG. 6A1 can be a standard RJ11 connector (e.g., an Ethernet connector) that can provide wired access to the Internet. A user can program and debug microcontroller U$1 (607) by mating connector J1 (605) to a host device running a development platform, but only by using transformer isolation for the primary power due to the floating modulator design.

The left side of microcontroller U$1 (607) includes power supply nodes VDD (e.g., VDD_2, VDD_3, VDD_4, VDD_5, and VDD_6) and outputs A_HI (311) and B_HI (313). These outputs can send alternating 360 Hz drive signals to the high-side drivers described above with respect to FIG. 3. Self test channels AN (e.g., AN4, AN5, etc.) are analog ports that can provide self-test diagnostic capabilities for driver hardware. Hardware interrupt line INT3 (611) can connect microcontroller U$1 (607) to a WiFi component. In the implementation of FIGS. 6A1, 6A2, and 6B, commercially available WiFi components can be used including, for example, Microchip's MRF24WB0MA RF transceiver module chip. Alternatively, other optical or electrically isolated communication implementations can be used including Bluetooth, USB, fiber-optic communications, and the like.

The top right side of microcontroller U$1 (607) in FIG. 6A1 has a series of outputs CH_1 (613), CH_2 (615), CH_3 (617), CH_4 (619), and CH_5 (621). These outputs control the pulse width modulation process which, in turn, can adjust the visually apparent brightness of the LED string lights. The intensity of these LED string lights can be adjusted to any rate within the microcontroller's capability. While a rate of 210 Hz is preferred, any sub-multiple of the nominal music 44,100 samples per second rate can be used. This adjustment process is described in more detail below with respect to FIG. 12.

Further down the right side of microcontroller U$1 (607) in FIG. 6A1 is Over Current Interrupt circuit INT1 (623).

Figure 7:
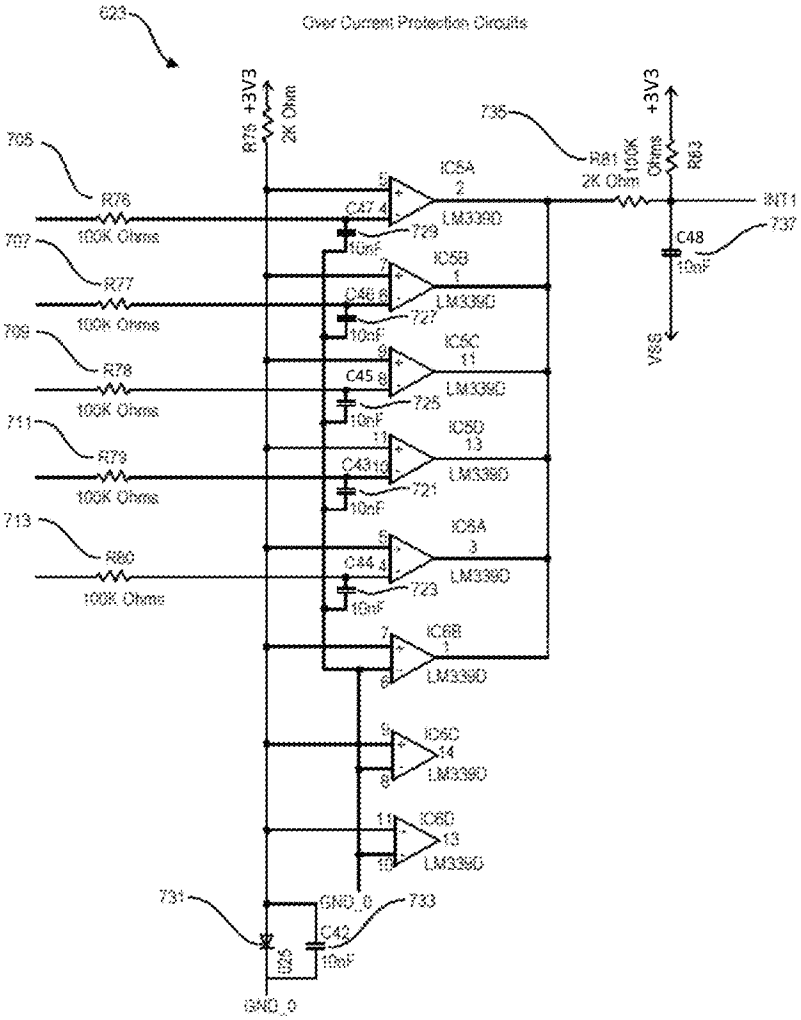
FIG. 7 is an Over Current Interrupt circuit consistent with an implementation of the current subject matter.

FIG. 7 illustrates Over Current Interrupt circuit INT1 (623) in more detail. This circuit can prevent destruction from an abnormal load (e.g., short circuit) or prevent further damage or overload from a failed component. The Over Current Circuit can interrupt microcontroller U$1 (607) when a fault condition is detected. In response to the interrupt, microcontroller U$1 (607) can shut down the high-side and low-side drive signals.

An over current fault condition can occur when a voltage in excess of 0.7V is detected across the current sensing resistors R38 (513) described above with respect to FIG. 5. As illustrated in FIG. 7, this voltage can be fed to open collector comparators through 100K Ohm resistors R76 (705), R77 (707), R78 (709), R79 (711), and R80 (713) and then passed through a low-pass filter having 10 nF capacitors C43 (721), C44 (723), C45 (725), C46 (727), and C47 (729) to prevent spurious triggering from fast transient signals. The positive input of open collector comparators U5 and U6 (there may be 4 comparators per IC package) can be maintained at 0.7V by diode reference D25 (731) which can be stabilized by capacitor C42 (733). Because the open collector comparators are tied together, microcontroller U$1 (607) can detect when any one of their outputs is low. Resistor R81 (735) and capacitor C48 (737) can provide additional noise immunity which can help the comparators from causing an unwanted interrupt.

Figure 6B:
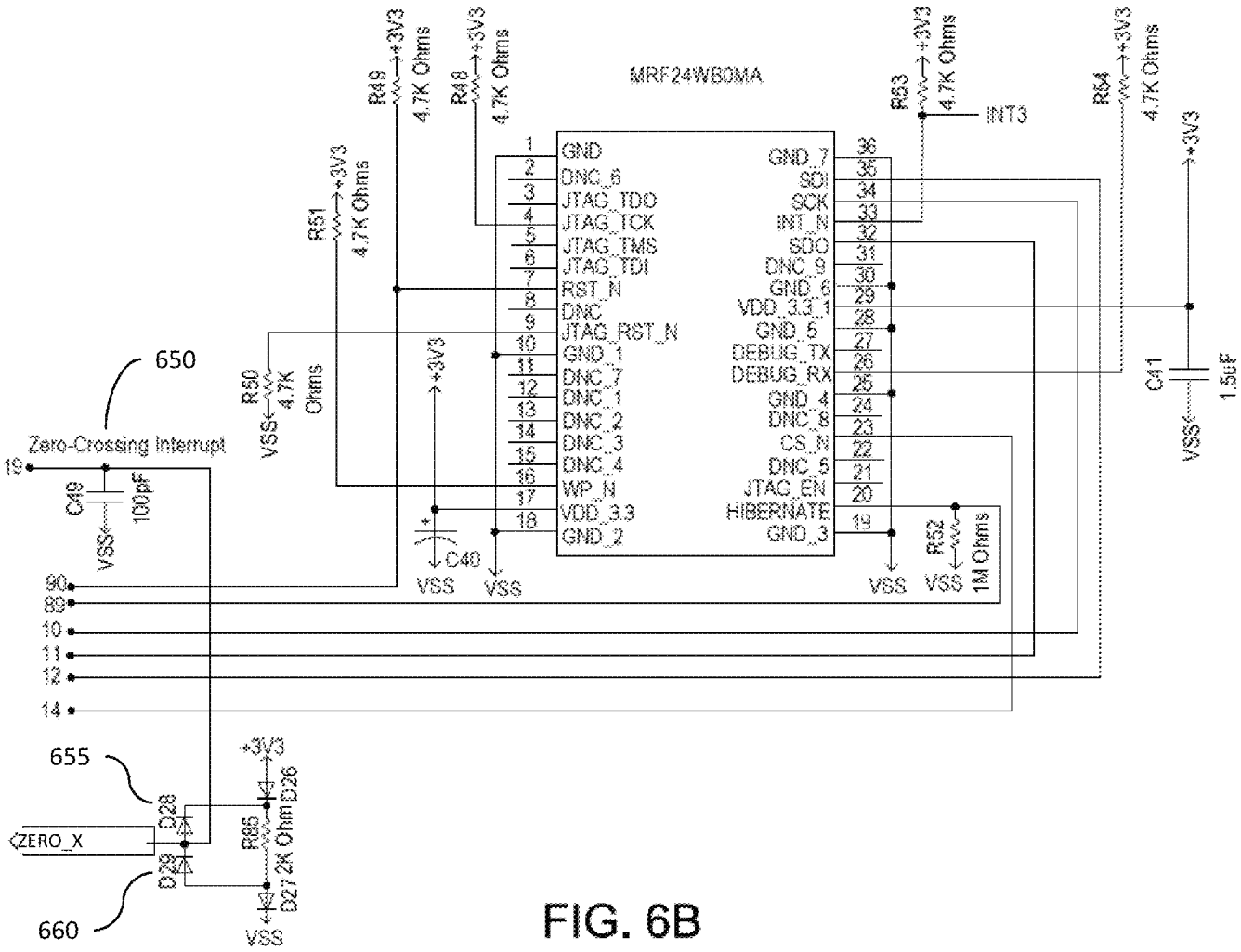

Microcontroller U$1 (607) of FIG. 6B also has a Zero Crossing Interrupt (650) which can provide resynchronization capabilities. Although microcontroller U$1 (607) is configured to operate at the line frequency, small variations in frequency can arise. The Zero Crossing Interrupt (650) can force microcontroller U$1 (607) to resynchronize at a rate of 60 times per second, once for each cycle of the wall-plug AC. Forced resynchronization ensures consistent LED string light brightness, particularly during periods when the LED string lights are being slowly modulated or maintained at a constant level. To ensure that the line voltage interrupt voltage is provided safely to microcontroller U$1 (607) which has a maximum 3.3V rating, the line voltage can be attenuated by two 1.0 M Ohm resistors in series (see FIG. 8) and clamped by diodes D28 (655) and D29 (660) to prevent the Zero Crossing Interrupt (650) from exceeding the absolute maximum ratings of the microcontroller.

The signal lines (630) on the lower right side of U$1 (607) can be used to communicate with the WiFi module using a standard peripheral interface (SPI). The WiFi module, which can be connected to power, ground, and microcontroller U$1 (607), can facilitate communication between microcontroller U$1 (607) and a media player through its RF interface. Custom modifications can be made to the microcontroller's WiFi software to facilitate block data transfers to microcontroller's U$1 RAM memory.

Power Supply

Figure 8:
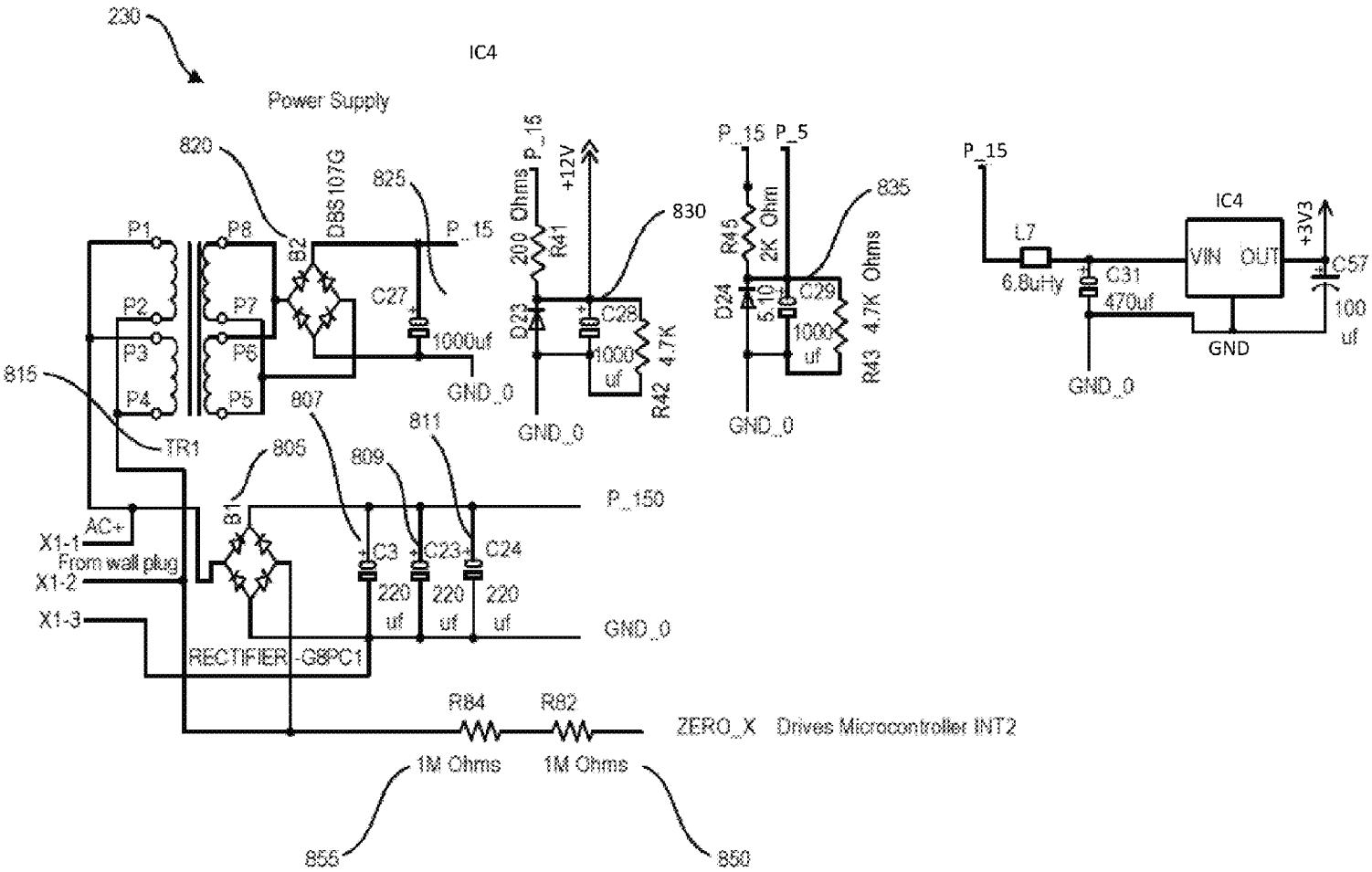
FIG. 8 is a circuit diagram of the power supply consistent with an implementation of the current subject matter.

Power supply 230 can be plugged directly into a wall outlet. As such, GND_0 of power supply 230 (as illustrated in FIG. 8) follows the lowest voltage side of the line voltage and, consequently, can float between 0 V and −150 V because there is no line isolation. Power supply 230 maintains a fixed potential relative to the entirety of the modulator electronics (i.e., the effects modulator) while the potential relative to earth ground (and the line neutral) varies or floats. This is possible because the only conductive connections with the effects modulator are the receptacles into which the LED string lights are plugged and the power line plug of the power supply. Because a separate power transformer is not needed, the effects modulator can be produced at a substantially lower weight, size, and cost. While the example of this paragraph assumes a line voltage of 110 V AC, a person of ordinary skill in the art would recognize that similar conditions apply in areas or countries with different line voltages (e.g., 220 V AC line voltage), albeit with a different floating voltage range.

Power supply 230 can have built-in safety features. Power supply 230 can be equipped with a ground-fault circuit interrupter to protect personnel during modulator operation. To protect the effects modulator, the string light outputs can be overload and short-circuit protected. To prevent overheating or fire, power supply 230 can have a fusible-link. In order to deter operators from opening up power supply 230, the power supply lacks any user serviceable parts inside the unit.

FIG. 8 is a circuit diagram of the power supply 230. Line voltage from the wall plug can enter on the left and can be fed through diode bridge B1 (805). Diode bridge B1 (805) can be a primary power rectifier. Capacitors C3 (807), C23 (809), and C24 (811) can be used for coarse voltage filtering and can provide a reasonably smooth 150 VDC voltage which can be used to drive the LED string lights. The need for further filtering can be mitigated by rapidly adjusting (e.g., at 210 times/sec) the LED pulse width of the low-side driver circuits 250, 255, 260, 265, and 270 to compensate for the characteristic 120 Hz ripple for full-wave bridge based rectifiers.

In order to run the microcontroller and MOSFET drivers, an isolated power supply can be provided through transformer TR1 (815). The signal can be rectified by diode bridge B2 (820) and smoothed by capacitor C27 (825) to provide unregulated DC at 15V. The regulated +12V required by the MOSFET drivers and the +5V required by the general logic can be supplied through zener diodes and large capacitors C28 (830) and C29 (835), respectively.

The microcontroller requires well filtered +3.3V at up to 300 mA. A switching regulator IC4 can be used to buck the +15V unregulated DC to 3.3 VDC.

Resistors R82 (850) and R84 (855) lying along the bottom of FIG. 8 can feed a sample of the line AC to the microcontroller. The microcontroller can use this sample as an interrupt to synchronize the light modulation to the line frequency. This configuration can prevent unwanted aliased LED light pulsing from occurring due to small differences between the line frequency and the microcontroller clock as described above with respect to the microcontroller's Zero Crossing Interrupt 650.

System Control

As described above with respect to FIG. 1, host controller 110 can transmit control signals to effects modulator 105 to turn LED strings light 120 on and off. This control data can include light intensity values for each LED which can be designated or modified using an effects editor. When a user selects a song to play using host controller 110, the host controller can transmit the lights effects data to microcontroller 205. Upon downloading this data, microcontroller 205 can control the circuits in FIGS. 3-5 to modulate the LED string lights over a continuum of brightness intensities from a minimum intensity (e.g., off) to a maximum intensity. The following sections describe the various processes executed by the effects editor, the host controller, and the microcontroller to control the LED string lights.

Effects Editor

The effects editor is a standard Digital Audio Workbench (DAW). This workbench can be implemented using a variety of commercially available audio and music production tools including, for example, Apple's Logic Pro series, Apple's GarageBand, AVID's Pro Tool series, and the like. Users of varying expertise can utilize MIDI (Musical Instrument Digital Interface) creation and editing features available in these production tools to create, edit, and release light-show compositions synchronized to their music of choice. For example, a user can assign one or more light strings to particular keyboard keys and assign effects to a MIDI channel. These effects can be added sequentially to the composition. These effects can be frozen to free up the rendered channels for additional effects. Many features available in the MIDI standard, such as "all keys off," pitch and modulation wheels, sustain pedal, program change, and the like, can be implemented to complement the musical effects composition.

Host software can transmit the MIDI signals to microcontroller 205 in effects modulator 105 from the DAW. In an implementation, a control program (such as an operating system software application) can intercept MIDI bus signals and transmit these signals to the effects modulator via a wired or wireless connection. While the TCP/IP protocol can be used to facilitate the transmission of these signals, the Universal Datagram Protocol (UDP) (also used in audio or video streaming applications) can also be used to minimize latency. The host software can be implemented as an audio unit or software instrument in the DAW.

An editor in the host software can provide a user interface for editing light effects waveform shapes. For example, a user can use the editor to adjust the rise time and decay profiles of a waveform shape. In addition to standard shapes provided by the editor, a user can also input their own arbitrary waveform shapes into the editor. Prior to composing, a user can upload a set of waveforms to microcontroller 205. In some implementations, the host software can automatically upload these waveforms to microcontroller 205. For example, when a user presses a key on an input device (e.g., a keyboard) operatively connected to host controller 110, the host controller can send a MIDI NOTE-ON message to effects modulator 105. Host controller 110 can also send MIDI channel data and the pitch and velocity associated with the pressed key to effects modulator 105. Upon receiving this data, effects modulator 105 can copy the waveform (specified by the MIDI channel data) for a particular light string (specified by the pitch) from local memory (e.g., internal RAM) into play buffers 210 and/or 215. In some implementations, these waveforms can be transmitted from host controller 110 to effects modulator 105. Effects modulator 105 can set the brightness for the copied waveform and the selected LED string light 120 using the velocity data.

Various techniques can be used to reduce latency between the playing of music and the adjusting of LED string light brightness. For example, while the waveforms described above can be stored at host controller 110 and transmitted to effects modulator 105, this configuration may incur a delay due to the lag associated with the transmission of this data. As such, local storage of these waveforms at effects modulator 105 may be preferred to reduce latency. In some implementations, waveforms can be progressively uploaded to effects modulator 105 in real time to reduce latency. For example, a waveform having a 3 second duration can be uploaded to effects modulator 105 in 0.5 second increments far enough ahead such that play buffers 210 and 215 do not run out of data. The uploading of waveforms can be initiated each time a key is pressed on an input device (e.g., a keyboard). These implementations can obviate the technical limitations associated with the one-to-one correspondence between the MIDI channels and waveforms.

A user can compose light effects for musical tracks using the DAW by progressively adding MIDI effect-triggering events to tracks within the DAW. These tracks can contain the MIDI information described above and can be modified in various ways (e.g., time shift, duration change, and other modifications typically performed on musical compositions). Various effects can be created using the editor. For example, a user can configure the editor to sustain a light effect when a user holds a key or presses the sustain pedal such that one or more lights maintain their current brightness or adjust their brightness to a predetermined level until the key or pedal is released. The user can review his/her composition until he/she is satisfied. When satisfied, the user can save the light effects composition separately from the music file or combine the light effects composition with the music file into a single file.

Host controller 110 can initiate playback of a music and light effects composition. Host controller 110 can be any standard consumer electronics device including, for example, a desktop computer, a laptop, a tablet computer, a smart phone, and the like. As host controller 110 plays music through music system 115, the host controller can transmit light effects data and synchronizing (timing) signals to effects modulator 105. If the light effects data is locally stored at effects modulator 105, host controller 110 can send a control signal to the effects modulator to trigger playback of the appropriate light effects file. Upon receiving this trigger, effects modulator can modulate the LED string lights in accordance with the light effects data. In these implementations, host controller 110 can transmit a timing signal (e.g., a tick) at predetermined intervals (e.g., 1 tick/second, 10 ticks/second, and the like) to effects modulator 105. Upon receiving a tick, effects modulator 105 can adjust its internal playback clock to ensure sure that it is synchronized with the host controller. Data can be transmitted among host controller 110, effects modulator 105, and music system 115 via a wired or wireless connection. In some implementations, multiple effects modulators 105 can be used. In these implementations, interfaces for discovering and configuring the effects modulators can be created.

In some implementations, music files and light effects files can be streamed to users via a network connection (e.g., over the Internet or from a broadcast source). If, for example, host controller 110 is GPS enabled, a broadcast signal having location specific light effects can used for large coordinated light displays (e.g., city wide light show).

Figure 9:
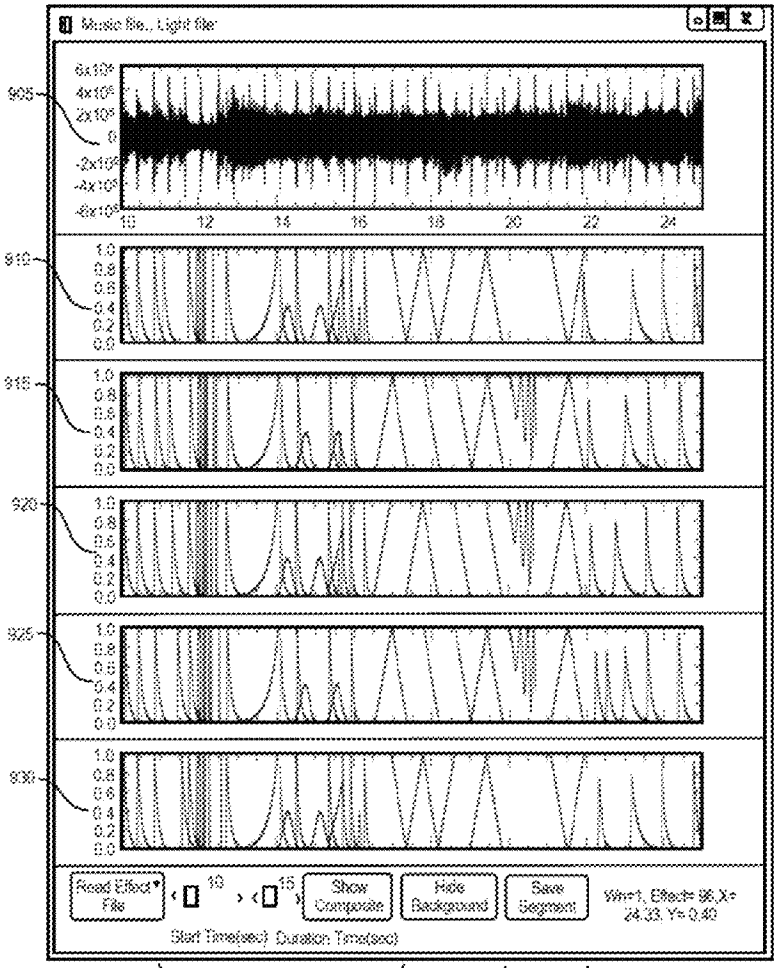
FIG. 9 illustrates an effects editor window consistent with an implementation of the current subject matter.

FIG. 9 illustrates a screen shot of an effects editor window than can be implemented using any of the commercially available DAWs specified above. This window illustrates six graphs, each displaying a waveform. Graph 905 represents a music file waveform. Graphs 910, 915, 920, 925, and 930 represent programmed LED light intensity waveforms for the five LED string lights during a 25 second time segment. When using a DAW, these waveforms can appear as MIDI blocks. These light intensity values can be normalized to fall within a 0 (off) to 1 (LEDs are fully on) range with 256 intermediate values. A person of ordinary skill in the art would recognize that a different number of graphs can be displayed in the effects editor window depending on the number of LED string lights connected to the effects modulator.

Figure 10:
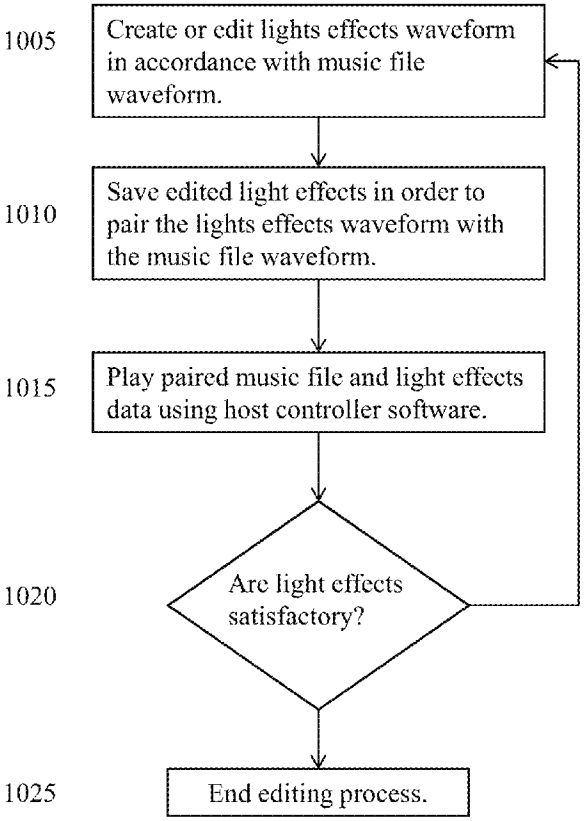
FIG. 10 illustrates a flowchart for adding light effects data to a music file using the effects editor consistent with an implementation of the current subject matter.

FIG. 10 illustrates a flowchart for adding light effects data to a music file using the effects editor. This flowchart will be discussed in conjunction with the effects editor window illustrated in FIG. 9.

At step 1005, a user can create or edit the light effects waveform data in accordance with music file waveform 905. Various editing operations are available in the effects editor application. For example, a user can adjust the start time and duration of the waveform time segments using slider bars and arrow buttons 940 or pointing and dragging a desired time interval on the waveform itself. A user can also individually edit graphs 910, 915, 920, 925, and 930 by highlighting a graph and left-clicking on it using a standard computer mouse. A user can also right-click on the graph to create a new, identical graph.

At step 1010, the light effects data can be paired with the music file by pressing "Save Segment" button 935 of FIG. 9. Pressing button 935 can save the graphs displayed in the effects editor window to a .wav file (for music waveform 905) and an effects file (for light intensity waveforms 910, 915, 920, 925, and 930). The effects file type is unique to this application and can be a binary (byte) file that can be n-bytes wide where n corresponds to the number of channels (i.e., LED string lights) used. For example, in the implementation of FIG. 1, the effects file can be five bytes wide because five sets of LED strings lights are used. Other file formats can also be used including, for example, MIDI files supported by the DAW software.

At step 1015, the paired light effects data and music file can be played. Media player 110 acting as a host controller can read the effects file and transmit control data in accordance with the effects file to microcontroller 205 via a wireless connection. Because host controller file names can be set ahead of time, the paired light effects data and music file can be played immediately after being saved at step 1010.

If a user is not satisfied with the effects (step 1020), the user can repeat the editing process by looping back to step 1005. If the user is satisfied with the effects, then the editing process ends at step 1025.

Host Controller

Host controller or media player 110 can play light effects enabled music by transmitting data to microcontroller 205. Host controller code can be written to control this transmission process. Various programming languages including, for example, Objective C, can be used to implement this code.

Figure 11:
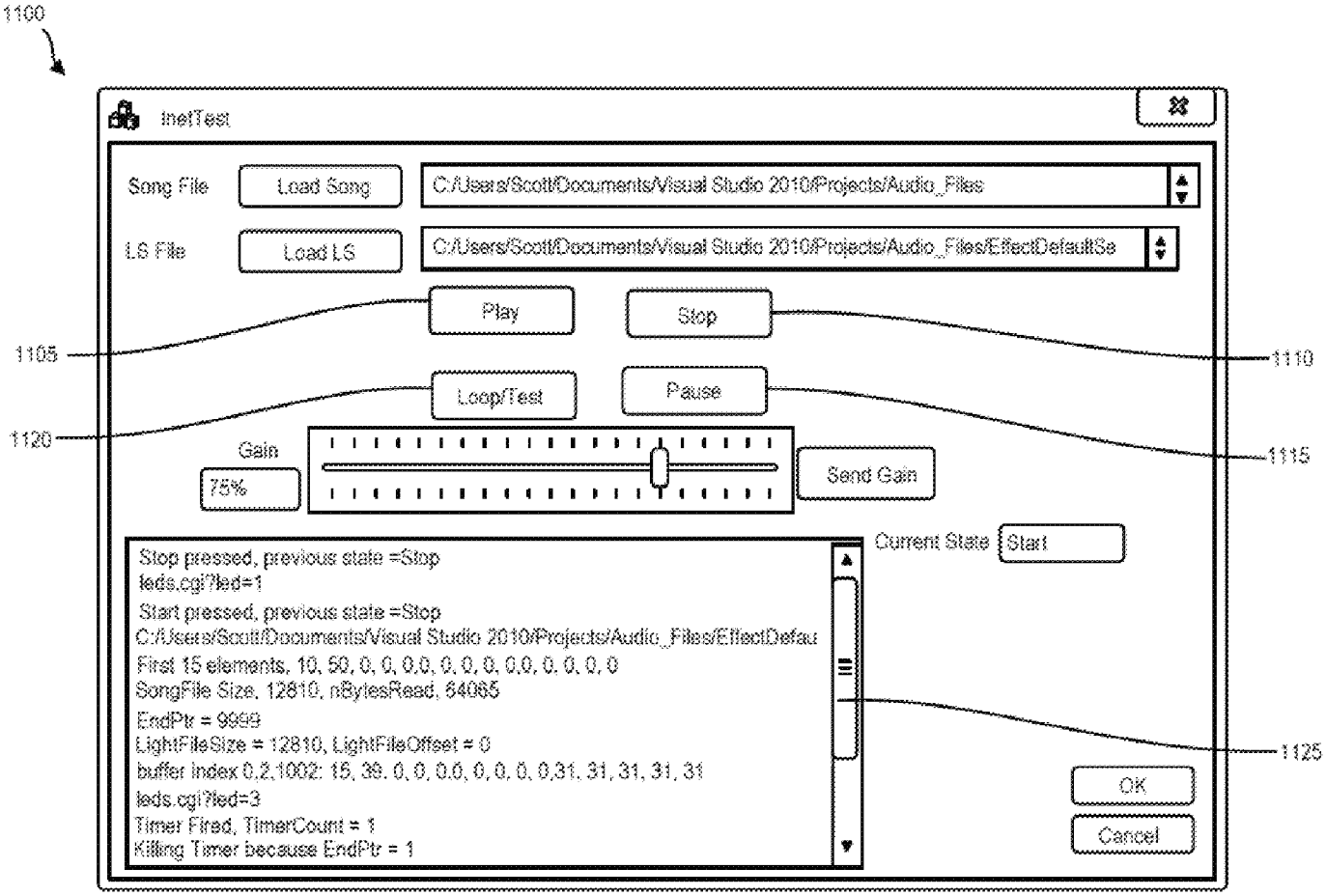
FIG. 11 illustrates an exemplary host controller window having active button controls consistent with an implementation of the current subject matter.

A user can operate media player 110 using controller window 1100 illustrated in FIG. 11. This window includes a play button 1105, stop button 1110, pause button 1115, a loop/test button 1120 and a general status text display window 1125. When any of the buttons are pressed, media player 110 can transmit the associated command to microcontroller 205.

Two separate file sections are needed to play a light effects enabled song—a song segment (for example, a .wav file, a .mp3 file, a .mp4 file, and the like) and an effects file segment. The files can be maintained as separate entities, or combined into a single file. When play button 1105 is pressed, media player 110 can transmit a single buffer's worth of effects data (e.g., 50,000 bytes) to microcontroller 205. The music file can be played directly by standard consumer music playing software in media player 110. In other implementations, media player 110 can transmit the music file to a remote WiFi-enabled music sound system or WiFi-enabled low power FM transmitter for external listening.

An effects file segment is a sequence of control data having a sequence of bytes that can be used to control the n-sets of LED string lights. In the implementation of FIG. 1, the effects file segment can have five bytes for each (1/210) second time slice when five sets of LED string lights are used. Media player 110 can set a timer to continue transmitting data to microcontroller 205 at suitable intervals until all the music and effects data has been sent. Alternatively, the effects file segment can be in the form of a MIDI file or other form containing the effects information.

Microcontroller Code

Microcontroller 205 can modulate the LED string light brightness in accordance with data received from media player 110. As mentioned above, commercially available products including, for example, Microchip's PIC32MX795F512 microcontroller can be used. The microcontroller code block diagram illustrated in FIG. 12 takes advantage of this chip's memory, timers, and external interrupt capabilities.

Figure 12:
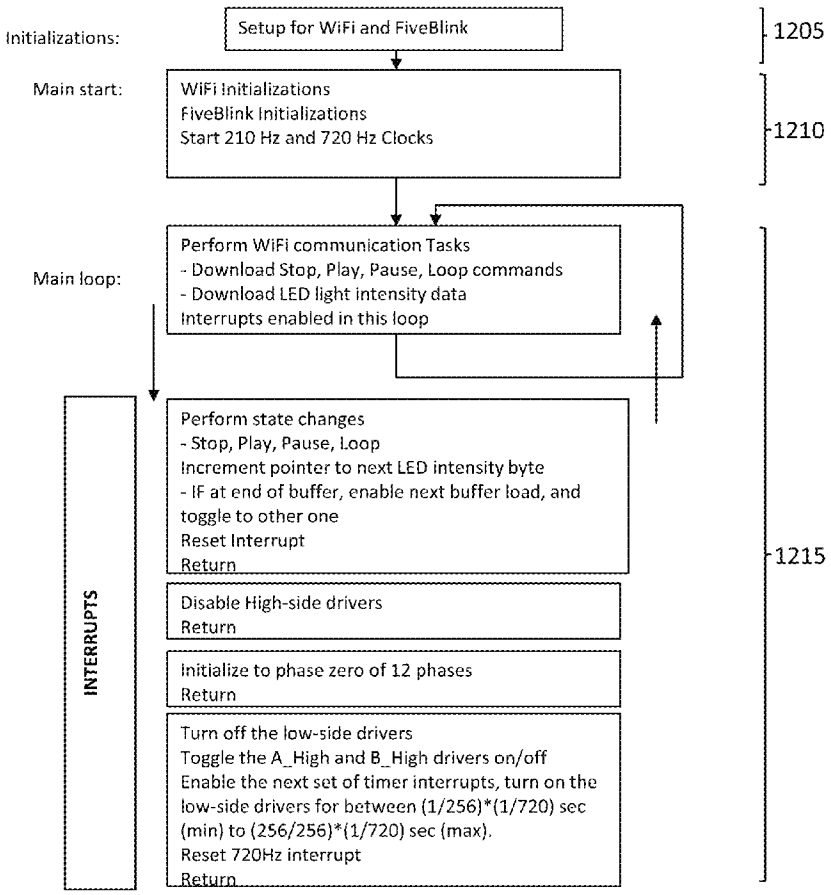
FIG. 12 is an overview of the code executed by a microcontroller consistent with an implementation of the current subject matter.

The code block diagram illustrated in FIG. 12 is divided into three sections—initializations 1205, main start 1210, and main loop 1215.

Initializations section 1205 can set up the microcontroller's WiFi circuitry. This set up enables wireless or other wired communication between microcontroller 205 and media player 110. Set up can also be performed to control the LED string lights (i.e., the "FiveBlink" program for controlling the five sets of LED string lights).

Main start section 1210 can initialize the WiFi connection and perform FiveBlink initializations. In addition, the sample update 210 Hz clock and the 720 Hz toggling clock can be started.

Main Loop section 1215 can perform WiFi or wired communication tasks. These tasks can include the downloading of stop, play, pause, and loop commands from the host controller and the downloading of light effects data. In addition, a variety of interrupts can be enabled in this loop. These interrupts can include, for example, a 210 Hz interrupt (to perform state changes), an over current interrupt (to disable high-side drivers), a line interrupt (to initialize the phases to zero), and a 720 Hz interrupt (to commutate the high-side driver circuitry and the low-side driver circuitry).

The 720 Hz interrupt is a programmed internal timer interrupt that can create the alternating 360 Hz drive voltage for the string lights. Using this interrupt, the MOSFET on the A side (275) of the high-side driver 245 can be turned on (connected to the +150V) while the MOSFET on the B side (280) of the high-side driver 245 can be turned off (represented, for example, by a high-impedance state or an open circuit). Subsequently, 1/720 second later, these roles are reversed, with the MOSFET on the A side (275) of the high-side driver 245 turned off and the MOSFET on the B side (280) of the high-side driver 245 connected to the +150V. When the MOSFET on the A side (275) of the high-side driver 245 is turned to an on state, the five low-side drivers 250, 255, 260, 265, and 270 can be individually turned on for a length of time (less than or equal to 1/720 sec) commensurate with the brightness setting on each individual channel. During each half cycle (i.e., 720 times per second), each of CH_1, CH_2, etc. can be active between 0 and 1/720 second with a resolution of 8 bits or 256 brightness levels. Thus, the shortest "ON" time is (1/720)*(1/256) sec, or 5.43 microseconds, and the longest is (1/720)*(256/256) or 1.39 milliseconds.

Modifications can be made to the vendor provided microcontroller code to support additional features. These modifications can allow, for example, microcontroller 205 to receive data from media player 110 and to recognize the stop, play, pause, and loop commands discussed above. With regard to the receipt of data, a callback routine can be implemented to download data from media player 110 to buffers 210 and 215 in the alternating fashion described above.

In some implementations, the code block diagram of FIG. 12 can include a "Compose" mode that enables the effects modulator to respond to MIDI signals transmitted from various sources including the Digital Audio Workshop (DAW), live keyboard, other MIDI signal generating devices, and the like. Standalone host system software or software plugin units to those DAW's can intercept, translate, and send the MIDI signals to the effects modulator. Waveforms that are pre-loaded into the effects modulator can be triggered by the MIDI events. Waveforms can also be stored in the host software and transmitted in real-time to the effects modulator. Low latency can be achieved using a combination Universal Datagram Protocol and TCPIP Protocol, or by using a USB port on the effects modulator. Software can be generated to create, store, and upload waveform sets, as well as uploading custom waveforms created by the musical professional.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. While the figures illustrate the use of MOSFETs, other types of low speed or medium speed high voltage solid state switches can be used to implement the functionality of these MOSFETs including, for example, bipolar junction transistors (BJTs), isolated gate bipolar transistors, silicon-carbide based high voltage transistors, and the like. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for a plasma display or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results.

What is claimed is:

1. A system comprising:

a host controller;

one or more strings of light, each string of light comprising at least one LED light; and an effects modulator operatively connected to the host controller and to the one or more strings of light, the effects modulator comprising:

a microcontroller, and an inverter configured to supply a voltage across each of the one or more strings of light, the inverter comprising a high side driver circuit and one or more low side driver circuits operatively connected to the high side driver circuit, each of the one or more low side driver circuits operatively connected to one of the one or more strings of light, wherein the microcontroller is configured to receive one or more control signals from the host controller and control the one or more strings of light via the inverter in accordance with the one or more control signals so as to alternate a polarity of the voltage for each of the one or more strings of light between a positive polarity and a negative polarity during operation of the one or more strings of light.

2. The system of claim 1, wherein the high side driver circuit further comprises a first side having a first switch and a second side having a second switch, and wherein the microcontroller is configured to connect the first switch and the second switch to a DC voltage source in accordance with a predetermined pattern.

3. The system of claim 2, wherein the predetermined pattern connects the first switch to the DC voltage source during a first half of a drive frequency and connects the second switch to the DC voltage source during a second half of the drive frequency, and wherein the first switch and the second switch are configured to provide high side drive waveforms to the one or more low side driver circuits.

4. The system of claim 3, wherein the one or more low side drivers circuits are configured to receive the high side drive waveforms from the first switch and the second switch and turn on the one or more strings of light by staggering a turn on time for the one or more strings of light using the high side drive waveforms.

5. The system of claim 4, wherein the turn on time for the one or more strings of light are staggered by 25 nanoseconds to 694 microseconds.

6. The system of claim 1, wherein the first switch and the second switch are MOSFETs.

7. The system of claim 1, wherein one or more diodes are disposed between the high side driver circuit and the one or more low side driver circuits, the one or more diodes electrically isolating the one or more low side driver circuits from each other.

8. The system of claim 1, further comprising a power supply, wherein the inverter is configured to operate at a drive frequency that is greater than a frequency of a line voltage connected to the power supply.

9. The system of claim 8, wherein the power supply is configured to maintain a fixed potential relative to the effects modulator while a potential relative to earth ground floats.

10. The system of claim 1, wherein the effects modulator is operatively connected to the host controller by a hardwired link or a wireless communication link.

11. The system of claim 10, wherein the hardwired link is an opto-isolator link or a fiber optic link.

12. The system of claim 1, further comprising:

a zero crossing interrupt operatively connected to the microcontroller, the zero crossing interrupt configured to resynchronize the microcontroller to operate at a predetermined frequency.

13. The system of claim 1, further comprising:

an over current interrupt circuit operatively connected to the microcontroller, the over current interrupt circuit configured to interrupt the microcontroller and disable at least one of the high side driver circuit or the one or more low side driver circuits when a fault condition is detected.

14. The system of claim 1, further comprising:

an effects editor configured to create one or more light effects waveforms for the one or more strings of light and to transmit the one or more light effects waveforms to the microcontroller.

15. The system of claim 14, wherein the effects editor is further configured to intercept one or more MIDI signals representative of a MIDI event by an input device operatively connected to the effects editor and to transmit the one or more MIDI signals to the effects modulator.

16. The system of claim 15, wherein the MIDI event is a NOTE-ON event, and wherein the one or more MIDI signals comprises information representative of the NOTE-ON event, a channel associated with the NOTE-ON event, a pitch associated with the NOTE-ON event, and a velocity associated with the NOTE-ON event.

17. The system of claim 16, wherein the effects modulator is configured to receive the one or more MIDI signals from the effects editor, copy a light effect waveform corresponding to the received one or more MIDI signals into one or more play buffers in the microcontroller, and modulate the one or more strings of light in accordance with the copied light effect waveform.

18. The system of claim 1, wherein the host controller is configured to transmit one or more timing signals to the effects modulator at predetermined intervals to synchronize the effects modulator with the host controller.

19. The system of claim 1, wherein a pulse width of the one or more low side driver circuits is adjusted to reduce flicker.

20. An apparatus comprising:

a microcontroller; and an inverter configured to supply a voltage across each of a plurality of strings of light, the inverter comprising a high side driver circuit and one or more low side driver circuits operatively connected to the high side driver circuit, each of the one or more low side driver circuits operatively connected to one of the plurality of strings of light, wherein the microcontroller is configured to receive one or more control signals from a host controller and control the plurality of strings of light in accordance with the one or more control signals so as to alternate a polarity of the voltage for each of the plurality of strings of light between a positive polarity and a negative polarity during operation of the plurality of the strings of light.

21. The apparatus of claim 20, wherein the high side driver circuit further comprises a first side having a first switch and a second side having a second switch, and wherein the microcontroller is configured to connect the first switch and the second switch to a DC voltage source in accordance with a predetermined pattern, and wherein the first switch and the second switch are configured to provide high side drive waveforms to the one or more low side driver circuits.

22. The apparatus of claim 20, wherein the one or more low side drivers circuits are configured to receive the high side drive waveforms from the first switch and the second switch and turn on the plurality of strings of light by staggering a turn on time for the plurality of strings of light using the high side drive waveforms.

* * * * *